US006869505B2

(12) United States Patent
Lares et al.

(10) Patent No.: US 6,869,505 B2
(45) Date of Patent: Mar. 22, 2005

(54) METHOD FOR CALENDERING A BOARD WEB

(75) Inventors: Matti Lares, Helsinki (FI); Mikko Tani, Appleton, WI (US)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/257,885

(22) PCT Filed: Apr. 17, 2001

(86) PCT No.: PCT/FI01/00378

§ 371 (c)(1),
(2), (4) Date: Feb. 24, 2003

(87) PCT Pub. No.: WO01/83883

PCT Pub. Date: Nov. 8, 2001

(65) Prior Publication Data

US 2003/0150581 A1 Aug. 14, 2003

(30) Foreign Application Priority Data

Apr. 18, 2000 (FI) ..... 20000927

(51) Int. Cl.[7] ..... D21G 1/02; D21F 11/00
(52) U.S. Cl. ..... 162/206; 162/207
(58) Field of Search ..... 162/135–137, 162/204–207, 265, 360, 361, 358.1, 358.3, 358.5, 359.1, 360.2, 360.3; 100/38, 153, 155 R, 156, 161, 164, 327–336, 305

(56) References Cited

U.S. PATENT DOCUMENTS 4,948,466 A * 8/1990 Jaakkola ..... 162/207
5,439,559 A * 8/1995 Crouse ..... 162/358.5
5,483,873 A * 1/1996 Koivukunnas et al. ..... 100/38
5,522,312 A 6/1996 Johnson
5,607,553 A 3/1997 Chadha
5,836,242 A * 11/1998 Aberg ..... 100/327
5,938,895 A 8/1999 Hirvonen
6,332,953 B1 * 12/2001 Singh et al. ..... 162/134
6,497,790 B2 * 12/2002 Mohan et al. ..... 162/206

FOREIGN PATENT DOCUMENTS

WO WO 96/28609 * 9/1996 ..... D11G/1/00
WO WO 96/28609 A1 9/1996
WO WO 99/67462 A1 12/1999
WO WO 99/67462 * 12/1999 ..... D21G/1/00
WO WO 00/03087 A1 1/2000
WO WO 00/03087 * 1/2000 ..... D21G/7/00
WO WO 01/83883 A1 11/2001

OTHER PUBLICATIONS

Search Report issued in Finnish Priority Application No. 20000927.
International Search Report issued in International Patent Application No. PCT/FI01/00378.
International Preliminary Examination Report issued in International Patent Application No. PCT/FI01/00378.

* cited by examiner

*Primary Examiner*—Peter Chin
*Assistant Examiner*—Eric Hug
(74) *Attorney, Agent, or Firm*—Stiennon & Stiennon

(57) ABSTRACT

A long nip (N) shoe calender formed of a shoe roll (10) and a thermo roll (20) is used in calendering, with a nip dwell time which is over 10 ms, advantageously over 20 ms. The nip pressure is below 3 MPa, advantageously below 1 MPa, and a surface temperature of the thermo roll (20) is over 200° C., advantageously over 250° C. The board web (W) surface to be pressed against the thermo roll (20) is moisturized before the nip.

5 Claims, 1 Drawing Sheet

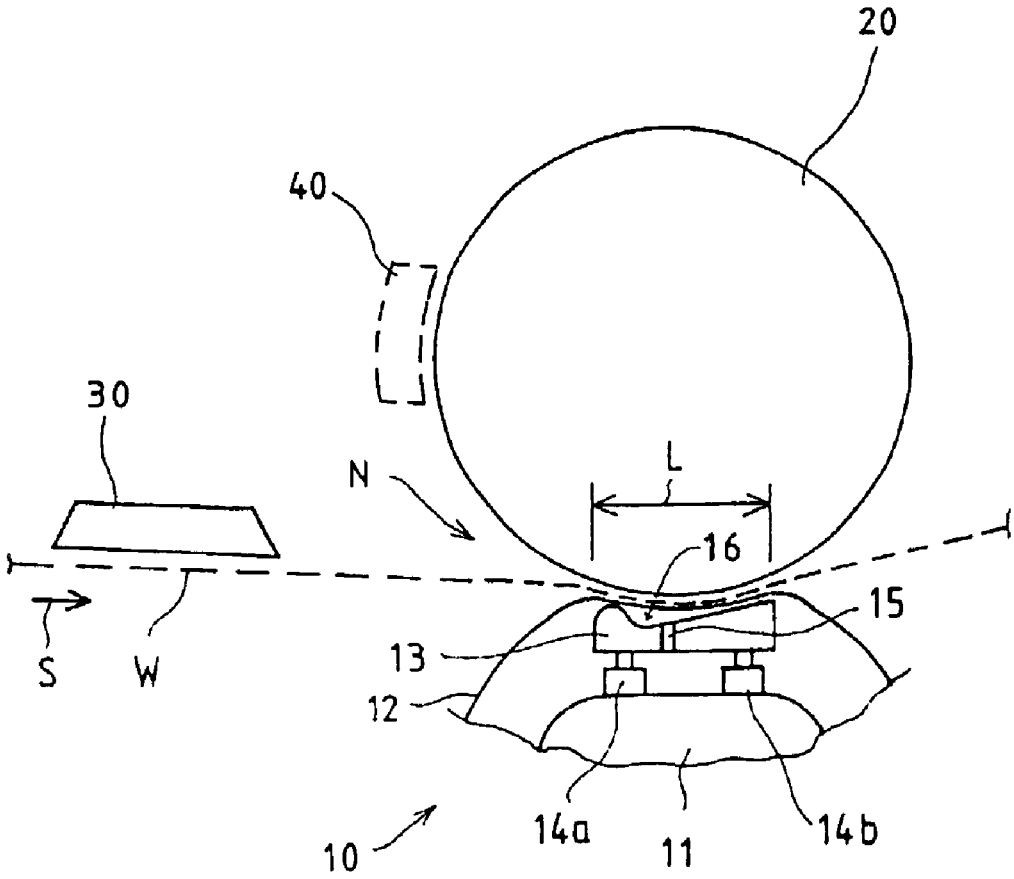
20
40
30
N
L
16
15
13
12
S
W
14a
11
14b
10

METHOD FOR CALENDERING A BOARD WEB

CROSS REFERENCES TO RELATED APPLICATIONS

This application is a U.S. national stage application of International Application No. PCT/FI01/00378, filed Apr. 17, 2001, and claims priority on Finnish Application No. 20000927 filed Apr. 18, 2000, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for calendering a board web.

A Yankee cylinder is generally used in the manufacture of sufficiently stiff board grades which are suitable for packages, for example, for biscuit/cookie packages, cosmetic packages, etc. and one side of which is additionally required to have good surface properties. After the treatment with a Yankee cylinder, the board surface which has been against the Yankee cylinder is subjected to surface treatment. After the surface treatment, the board web is further subjected to final calendering, when needed. The web treated with a Yankee cylinder is given good surface properties, good bulk and stiffness and low shrinkage at the edges.

The most important quality properties of board produced by a Yankee cylinder before coating are in a range: bulk 1.4–1.6 $dm^3$/kg, Bendtsen roughness 50–250 ml/min and PPS-s10 roughness 3.5–7.5 $\mu$m.

One problem with the use of a Yankee cylinder is its runnability. The Yankee cylinder can be run only in a relatively narrow operating window. The web must be sufficiently moist when it arrives at the Yankee cylinder in order that it should properly adhere to the hot and smooth outer surface of the shell of the Yankee cylinder by the action of adhesion. On the other hand, the web must not be too moist when it arrives at the Yankee cylinder in order that it shall have time to dry sufficiently on the Yankee cylinder. If the web does not have time to dry sufficiently on the surface of the Yankee cylinder, it cannot be detached from the surface of the cylinder at the trailing end of the cylinder. Separation of the web from the hot outer surface of the Yankee cylinder takes place by means of a doctor. The above-mentioned runnability problems have limited the running speed of the Yankee cylinder with board grades of this kind to a range of below about 600 m/min. Typically, the running speeds of the Yankee cylinder are in a range of about 200–400 m/min. Moreover, the shell of the Yankee cylinder, the diameter of which may be as large as 7 m, shall meet strict requirements in respect of deformation, thermal conductivity, wear and corrosion, with the result that the Yankee cylinder will be relatively expensive. In addition, an impingement device is normally used in connection with the Yankee cylinder.

The above-mentioned board grades can also be produced without a Yankee cylinder, in which connection the web can be provided with desired surface properties by means of a wet stack calender. The wet stack calender is formed of a multinip hard nip calender, but the calendering process totally differs from conventional hard nip calendering. The wet stack calender makes use of moisture gradients. The web is dried before the wet stack calender such that its moisture content is only about 1–2%. On the wet stack calender, water boxes are used in connection with 1–3 rolls for forming a film of water onto the outer surface of the roll shell before a nip. This water film is pressed onto the surface of the web in the nip. The relatively thick web is moistened only from the surface thereof, in which connection, by the action of simultaneous pressure, the web is calendered more on the surface as compared with the over-dried interior of the web. This kind of calendering results in a good smoothness to bulk ratio, i.e. good smoothness is obtained, however, without losing too much bulk. Surface treatment and possibly final calendering of the web are carried out after the wet stack calendering.

Runnability problems are also associated with the wet stack calendering. If the pressure distribution in the nips provided with water boxes is not sufficiently uniform, water can pass through the nip, forming a pocket of water underneath the web. This causes web breaks at the next nip. Since bulk is a critical factor with board grades, it must be possible to operate the calender with an optimal nip pressure required by each board grade, which pressure is sufficiently uniform in the entire area of the nip allowing the use of water boxes. The wet stack calender is designed so that the number of rolls can be varied therein and deflection-compensated rolls are placed such that a sufficiently uniform nip pressure is achieved in the nips provided with water boxes. In the wet stack calender, wrinkles are also readily formed in the web, in particular in a web having a low basis weight.

Metso Paper, Inc.'s U.S. Pat. No. 5,938,895 discloses one wet stack calender with a water box positioned in connection with a profiling nip formed by a deflection-compensated roll placed in the middle of the calender. U.S. Pat. No. 5,522,312 discloses a wet stack calender in which a metering device is used in connection with a water box for controlling the thickness and uniformity of a water film applied to a calender roll. The water is transferred from the calender roll to the web at a nip. U.S. Pat. No. 5,607,553 discloses a wet stack calender in which the water boxes have been replaced by water spray devices for spraying water in the form of droplets to a reversing roll of the calender. The water is transferred from the reversing roll to the web at a nip.

WO 99/67462 discloses a method for calendering paper or board when manufacturing coated grades of paper or board in two stages. In the first stage, i.e. the pre-calendering stage, the uncoated web is calendered with a shoe calender having a shoe length of at least 50 mm after which the web is coated. In the second stage the coated web is calendered with a calender having a nip length of 50 mm at the most. The maximum pressure in the pre-calendering nip is kept at 0 to 15 Mpa, preferably at 4 to 12 Mpa. The web is pre-calendered at a moisture and temperature where at least the glass transition temperature of the material forming the surface part of the web has been reached. The web may be pre-treated e.g. by steaming and/or wetting with water or a combination of pre-wetting and the use of a heated backing roll in the shoe calender can be used in order to reach the glass transition temperature. The dwell time of the web in the calender is 3 to 40 ms.

WO 96/26809 discloses a coated paperboard for formed articles, e.g. liquid packaging board or white top liner. The paperboard consists of a fibermatrix in one, two or more layers and a coating and has adequate surface gloss for each specific type of formed articles. The paperboard has been calendered only after it has been coated with a heated calender having a soft extended nip. The specification mentions that the calender temperature is typically in the range of 140–250° C., but even higher temperatures are possible. The length of the nip in the so called supersoft calender which can be used in calendering the coated web is said to be 40 to 60 mm. Although the main idea in this document is to calender only the coated web, i.e. not the uncoated web it is said that it is also possible to calender the uncoated web in addition to the calendering of the coated web.

WO 00/03087 discloses a method for manufacturing surface-treated printing paper. The web is first dried down in the drying section typically to a moisture of 2 to 4%, and it is wetted again typically to a moisture of 8 to 12% before surface treatment, e.g. calendering in a multi-nip calender. The wetting device is placed before the calender so that the absorption time of the water is 0.2 to 2.0 s before the web reaches the calender. The amount of water used in the method is 0.1 to 10 g/m$^2$ and the droplet size in the spray-moistener is 10 to 100$\mu$.

U.S. Pat. No. 5,836,242 discloses a calendering system in a papermaking or board manufacturing process. The system comprises at least one press nip and an endless calender belt comprising a core and a compressible, elastic material bonded to the core. The belt comprises at least two layers having different hardnesses. The web side has a first hardness in the range of 75 to 91 Shore A and the layer on the press side has a second higher hardness. The average pressure used in this calender is higher than 4 MPa.

Because of the above-mentioned limitations, in the case of the above-mentioned board grades it would be desirable to replace the Yankee cylinder and the wet stack calender with some new improved arrangement. As one new arrangement, trials have been carried out with the long nip calender known in itself, but so far the results have not been good enough.

By a long nip calender is meant a calender in which a nip is formed between a heatable steel roll and a belt. In the long nip calender, the nip pressure can be adjustable in the cross direction (CD) of the machine, in which connection it is possible to profile, for example, the caliper of paper. The long nip calender can be formed of a belt calender in which a belt is passed as guided by auxiliary rolls around one of the nip rolls, i.e. the roll operating as a backing roll for a thermo roll. Thus, a long nip is formed between a thermo roll and the other nip roll loading the belt. The most common long nip calender is a shoe calender in which a belt is arranged to run around a stationary support structure and in which the belt is loaded against a thermo roll by means of a loading shoe positioned inside the loop of the belt and supported on the support structure. The long nip is formed in the shoe calender between the thermo roll and the shoe loading the belt. Thus, the length of the nip is determined by the loading shoe of the shoe calender. The method according to the invention is primarily suitable for use in connection with the above-mentioned shoe calender.

In the prior art shoe calenders which are in use, the length of the nip is typically in a range of 50–70 mm, i.e. the dwell time of the web in the nip is considerably less than 10 ms. The surface temperature of the thermo roll serving as the backing roll of the shoe roll is in a range of 80–200° C. and the maximum pressure of the nip is in a range of 5–10 MPa. The hardness of the calender belt of the shoe calender is in a range of 80–100 ShA. Longer nips of about 270 mm have been used in presses based on the shoe roll.

SUMMARY OF THE INVENTION

In the method according to the invention, good calendering results have been totally unexpectedly achieved by calendering the web with a shoe calender in a parameter range that is contrary to the present preconception of a person skilled in the art.

In trials carried out on a shoe calender, it was unexpectedly found that by operating the shoe calender with parameter values that considerably differ from the parameter values known until now, a good calendering result was achieved in particular with the above-mentioned board grades. In the shoe calender, a nip was used which was considerably longer than normal such that a nip dwell time of over 10 ms, advantageously over 20 ms, was achieved. In addition, a very low nip pressure of below 3 MPa, advantageously below 1 MPa, and a higher than normal surface temperature of over 200° C., advantageously over 250° C. in the thermo roll were used. The web surface pressed against the thermo roll was also subjected to water moisturizing before the shoe calender.

In the method according to the invention, it is also advantageous to use a calender belt having a hardness of below 100 ShA, preferably below 80 ShA.

BRIEF DESCRIPTION OF THE DRAWINGS

The method according to the invention is described in the following with reference to the accompanying FIGURE, to the details of which the invention is not intended to be exclusively confined.

DESCRIPTION OF THE PREFERRED EMBODIMENTS

The FIGURE schematically shows a shoe calender to which the method according to the invention can be applied. The shoe calender comprises here a shoe roll 10 and a heatable backing roll 20, i.e. a thermo roll. The shoe roll 10 is formed of a stationary support structure 11 and a belt shell 12 rotating around it. The belt shell 12 is loaded against the thermo roll 20 by means of a loading shoe 13 provided inside the belt shell 12 and supported on the support structure 11 by means of two rows of actuators 14*a*, 14*b* spaced from each other in the machine direction. The actuators 14*a*, 14*b* are advantageously formed of a cylinder-piston construction. The loading shoe 13 comprises lubricant feed ducts 15, by which a lubricant can be fed into a lubricant pocket 16 between the belt shell 12 and the frontal surface of the loading shoe 13, from which pocket it forms a lubricant film between the loading shoe 13 and the belt shell 12. A long nip N is formed between the belt shell 12 shaped by the loading shoe 13 and the outer surface of the shell of the thermo roll 20.

A web W is passed into the long nip calender from the direction shown by the arrow S. The web W surface to be pressed against the thermo roll 20 is moisturized by means of a moisturizing device 30 before the web W is passed into the long nip N. The moisture content of the web W before the moisturizing device 30 can be in a range of 1–20%, advantageously in a range of 1–10%. The moisturizing is accomplished by spraying atomized water onto the surface of the web in an amount of 1–20 g/m$^2$. Water is sprayed onto the surface of the web W such that its time of action before the nip is about 0.1–2 s. The aim here is that only the web W surface to be placed against the thermo roll 20 is moisturized. When needed, surface active agents can also be mixed into the water used for moisturizing in order to assist water to penetrate into the surface structures of the web.

The length L of the long nip N has been chosen according to the running speed at each particular time such that the dwell time of the web W in the long nip N is over 10 ms, advantageously over 20 ms. For example, at a running speed of 1500 m/min, the length of the nip shall be about 500 mm in order to achieve a dwell time of 20 ms.

The loading shoe 13 is loaded so that the web W is subjected in the nip N to a compression pressure of below 3 MPa, advantageously a compression pressure of below 1 MPa. The compression pressure naturally also has a lower limit, the desired calendering effect not being achieved at pressures lower than this lower limit. According to present knowledge, this lower limit is approximately about 0.1 MPa.

The thermo roll 20 is heated so that the temperature of the outer surface of its shell is over 200° C., advantageously over 250° C. The thermo roll 20 can be heated by circulating in the thermo roll a heating medium which is heated in a heating device provided outside the thermo roll. The thermo roll 20 can additionally be heated, for example, with an induction heater 40 placed in connection with the outer surface of the shell of the thermo roll 20 or inside the thermo roll. For example, water, steam or oil can be used as a heating medium.

In the trials carried out it was found that, for example, the web used for the manufacture of board grades known under the trade names White Lined Chipboard (WLC) and Folding Box Board (FBB) could be calendered by the shoe calender provided with the above-mentioned parameter values such that the quality of the calendered product was as good as or superior to the quality of corresponding board produced on a Yankee cylinder.

The most important quality properties of a web calendered by the method according to the invention before coating are thus in at least the following range: bulk 1.4–1.6 $dm^3/kg$, Bendtsen roughness 50–250 ml/min, and PPS-s10 roughness 3.5–7.5 $\mu$m.

The use of a Yankee cylinder and, as its alternative, of a wet stack calender can be replaced with the method according to the invention in the manufacture of at least the board grades WLC and FBB of the above-mentioned type. As a result of this, the efficiency of board manufacture can be increased considerably. The running speed of a Yankee cylinder is in a range of less than about 600 m/min and other runnability problems are associated with a wet stack calender. By contrast, considerably higher running speeds can be achieved with the shoe calender according to the invention, and its runnability is good. The method according to the invention can be applied to a shoe calender so that running speeds of even over 2000 m/min are achieved. The shoe calender does not in itself set any technical limitations to the calendering speed.

The claims are presented in the following and the details of the invention may differ within the inventive idea defined by said claims from the disclosure given above by way of example only.

What is claimed is:

1. A method for calendaring an uncoated board web for manufacture of board grades White Lined Chipboard (WLC) and Folding Box Board (FBB) in a long nip shoe calendar, the method comprising the steps of:

passing the web at a first speed through a long nip shoe calender having a long nip formed between a shoe roll and a thermo roll, the long nip having a length such that the dwell time of the web within the nip is greater than 10 ms, and applying a nip pressure below 3 MPa, and wherein a surface temperature of the thermo roll is greater than 200° C., and wherein a calender belt having a hardness of below 100 ShA is used on the shoe roll; and moisturizing the board web surface to be pressed against the thermo roll before the nip by spraying atomized water onto said board web surface in an amount of 1–20 $g/m^2$ such that the time of action of the water before the nip is about 0.1–2 s.

2. The method of claim 1 wherein the nip dwell time is greater than 20 ms.

3. The method of claim 1 wherein the nip pressure is below 1 MPa.

4. The method of claim 1 wherein the surface temperature of the thermo roll is greater than 250° C.

5. The method of claim 1 wherein the hardness of the calender belt is below 80 ShA.

* * * * *